US011485602B2

(12) United States Patent
Hidaka et al.

(10) Patent No.: US 11,485,602 B2
(45) Date of Patent: Nov. 1, 2022

(54) FOLDING APPARATUS AND IMAGE FORMING SYSTEM INCORPORATING SAME

(71) Applicants: Makoto Hidaka, Tokyo (JP); Takahiro Watanabe, Kanagawa (JP); Tomohiro Furuhashi, Kanagawa (JP); Michitaka Suzuki, Kanagawa (JP); Fumiharu Yoneyama, Kanagawa (JP); Kazuyoshi Matsuo, Kanagawa (JP); Koki Sakano, Kanagawa (JP); Akira Kunieda, Tokyo (JP); Takuya Morinaga, Tokyo (JP); Yohsuke Haraguchi, Kanagawa (JP); Wataru Takahashi, Tokyo (JP)

(72) Inventors: Makoto Hidaka, Tokyo (JP); Takahiro Watanabe, Kanagawa (JP); Tomohiro Furuhashi, Kanagawa (JP); Michitaka Suzuki, Kanagawa (JP); Fumiharu Yoneyama, Kanagawa (JP); Kazuyoshi Matsuo, Kanagawa (JP); Koki Sakano, Kanagawa (JP); Akira Kunieda, Tokyo (JP); Takuya Morinaga, Tokyo (JP); Yohsuke Haraguchi, Kanagawa (JP); Wataru Takahashi, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 242 days.

(21) Appl. No.: 16/890,152

(22) Filed: Jun. 2, 2020

(65) Prior Publication Data

US 2020/0407187 A1 Dec. 31, 2020

(30) Foreign Application Priority Data

Jun. 28, 2019 (JP) ..... JP2019-122006

(51) Int. Cl.
*B65H 43/00* (2006.01)
*B65H 45/14* (2006.01)
*B65H 29/12* (2006.01)

(52) U.S. Cl.
CPC ..... *B65H 45/147* (2013.01); *B65H 29/125* (2013.01); *B65H 2511/30* (2013.01)

(58) Field of Classification Search
None
See application file for complete search history.

(56) References Cited

U.S. PATENT DOCUMENTS 4,619,101 A * 10/1986 Havey, Jr. ..... B43M 3/045 53/284.3
4,917,366 A * 4/1990 Murakami ..... B65H 37/04 227/7

(Continued)

FOREIGN PATENT DOCUMENTS

| | | |
|---|---|---|
| JP | 2005-017692 | 1/2005 |
| JP | 2007-076865 | 3/2007 |
| JP | 2015-218014 | 12/2015 |

OTHER PUBLICATIONS

U.S. Appl. No. 16/715,608, filed Dec. 16, 2019, Suzuki Michitaka, et al.

*Primary Examiner* — Leslie A Nicholson, III
(74) *Attorney, Agent, or Firm* — Harness, Dickey & Pierce, P.L.C.

(57) ABSTRACT

An embodiment of this disclosure provides a folding apparatus configured to stack and fold a designated number of sheets at a time. The folding apparatus includes a conveyor configured to sequentially convey the designated number of sheets, a stacker configured to temporarily store a sheet conveyed by the conveyor to stack the designated number of sheets, a sheet folding device configured to fold the designated number of sheets at a time, and control circuitry. The (Continued)

control circuitry is configured to cause the sheet folding device to fold the stored sheet in response to an occurrence of a sheet jam upstream from the stacker in a direction of sheet conveyance, in processing the designated number of sheets.

10 Claims, 15 Drawing Sheets

(56) References Cited

U.S. PATENT DOCUMENTS

| | | | | |
|---|---|---|---|---|
| 7,484,731 | B2 * | 2/2009 | Gutierrez-Vazquez | G03G 15/502 271/259 |
| 9,841,715 | B2 * | 12/2017 | Miyake | B65H 43/04 |
| 10,017,350 | B2 * | 7/2018 | Ando | G03G 15/6541 |
| 2019/0276263 | A1 | 9/2019 | Hidaka et al. | |
| 2019/0284008 | A1 | 9/2019 | Sakano et al. | |
| 2019/0284009 | A1 | 9/2019 | Suzuki et al. | |
| 2019/0284010 | A1 * | 9/2019 | Asami | B65H 45/14 |
| 2019/0284011 | A1 | 9/2019 | Furuhashi et al. | |
| 2019/0367317 | A1 | 12/2019 | Haraguchi et al. | |

* cited by examiner

BEFORE FOLDING

FOLDING APPARATUS AND IMAGE FORMING SYSTEM INCORPORATING SAME

CROSS-REFERENCE TO RELATED APPLICATION

This patent application is based on and claims priority pursuant to 35 U.S.C. § 119(a) to Japanese Patent Application No. 2019-122006, filed on Jun. 28, 2019, in the Japan Patent Office, the entire disclosure of which is hereby incorporated by reference herein.

BACKGROUND

Technical Field

This disclosure relates to a folding apparatus and an image forming system incorporating the folding apparatus.

Related Art

There are folding apparatuses that receive a sheet on which an image is formed and folds the sheet. Further, there are folding apparatuses that fold a plurality of sheets at a time.

Before folding a plurality of sheets, a folding apparatus capable of folding a plurality of sheets temporarily stores the plurality of sheets to be folded, aligns the plurality of sheets, and then performs folding processing such as half fold or Z-fold.

SUMMARY

An embodiment of this disclosure provides a folding apparatus configured to stack and fold a designated number of sheets at a time. The folding apparatus includes a conveyor configured to sequentially convey the designated number of sheets, a stacker configured to temporarily store a sheet conveyed by the conveyor to stack the designated number of sheets, a sheet folding device configured to fold the designated number of sheets at a time, and control circuitry. While processing the designated number of sheets, in response to an occurrence of a sheet jam upstream from the stacker in a direction of sheet conveyance, the control circuitry causes the sheet folding device to fold the stored sheet.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
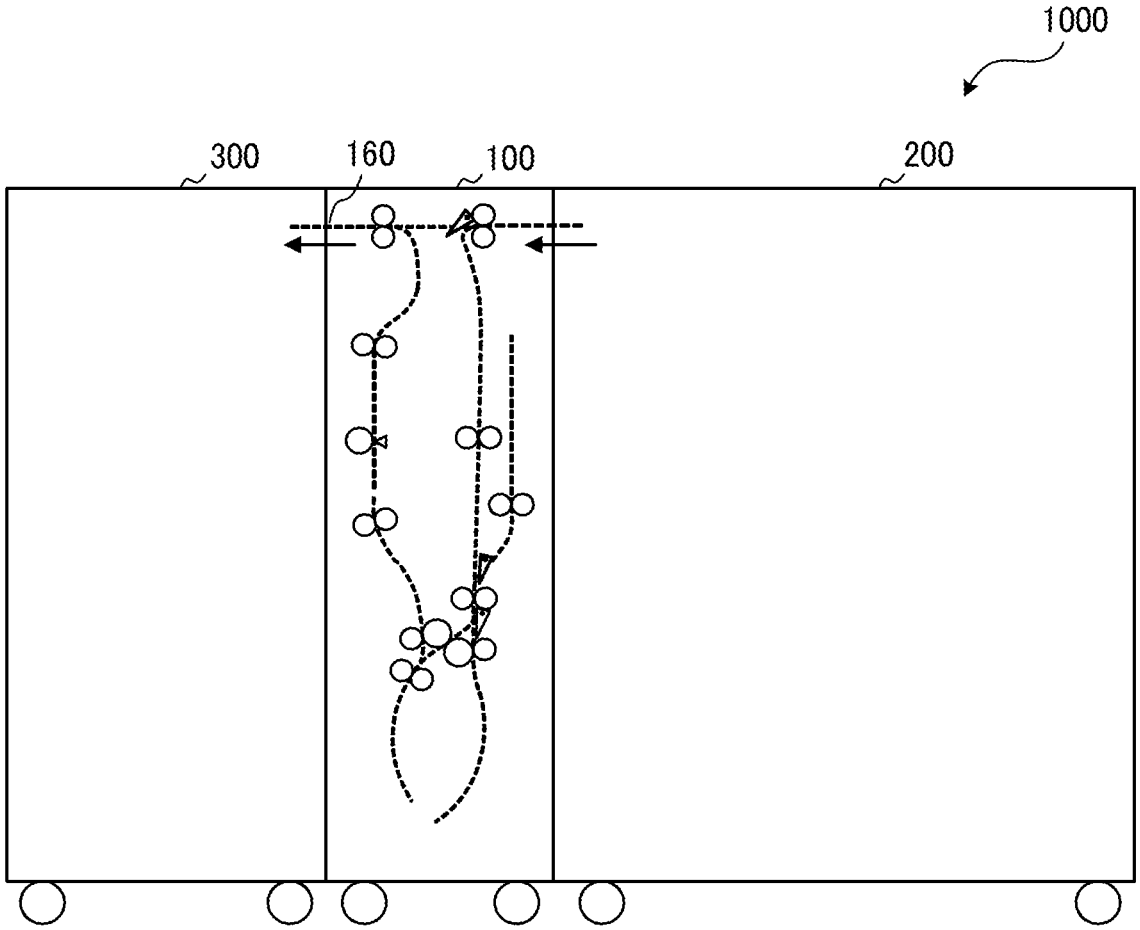
FIG. 1 is a view illustrating a general arrangement of an image forming system according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, embodiments of this disclosure are described. As used herein, the singular forms "a," "an," and "the" are intended to include the plural forms as well, unless the context clearly indicates otherwise.

Hereinafter, a folding apparatus and an image forming system according to an embodiment are described with reference to the drawings. In the description below, the term "image forming apparatus" signifies an apparatus that applies developer or ink to a sheet medium such as paper, overhead projector (OHP) transparency, yarn, fiber, cloth, leather, metal, plastic, glass, wood, ceramics, and the like, thereby forming an image thereon. Further, the term "image formation" signifies providing (i.e., printing) not only an image, such as texts and figures, having meanings but also a meaningless image, such as a pattern, onto a recording medium (a sheet).

In the following, embodiments are described using a "paper sheet" as an example of the sheet (sheet medium). In this specification, the dimensions, material, shape, and relative positions of components are examples. Unless otherwise specified, the scope of the present disclosure is not limited thereto.

FIG. 1 is a diagram illustrating an image forming system 1000 in which an image forming apparatus 200, a folding apparatus 100, and a finisher 300 are coupled. The image forming apparatus 200 is an apparatus that forms an image on a sheet and outputs the sheet after image formation to the folding apparatus 100. The folding apparatus 100 receives the sheet on which the image is formed and performs folding. The finisher 300 receives the sheet or a sheet bundle ejected from the folding apparatus 100, and performs post-processing such as stapling.

Figure 2:
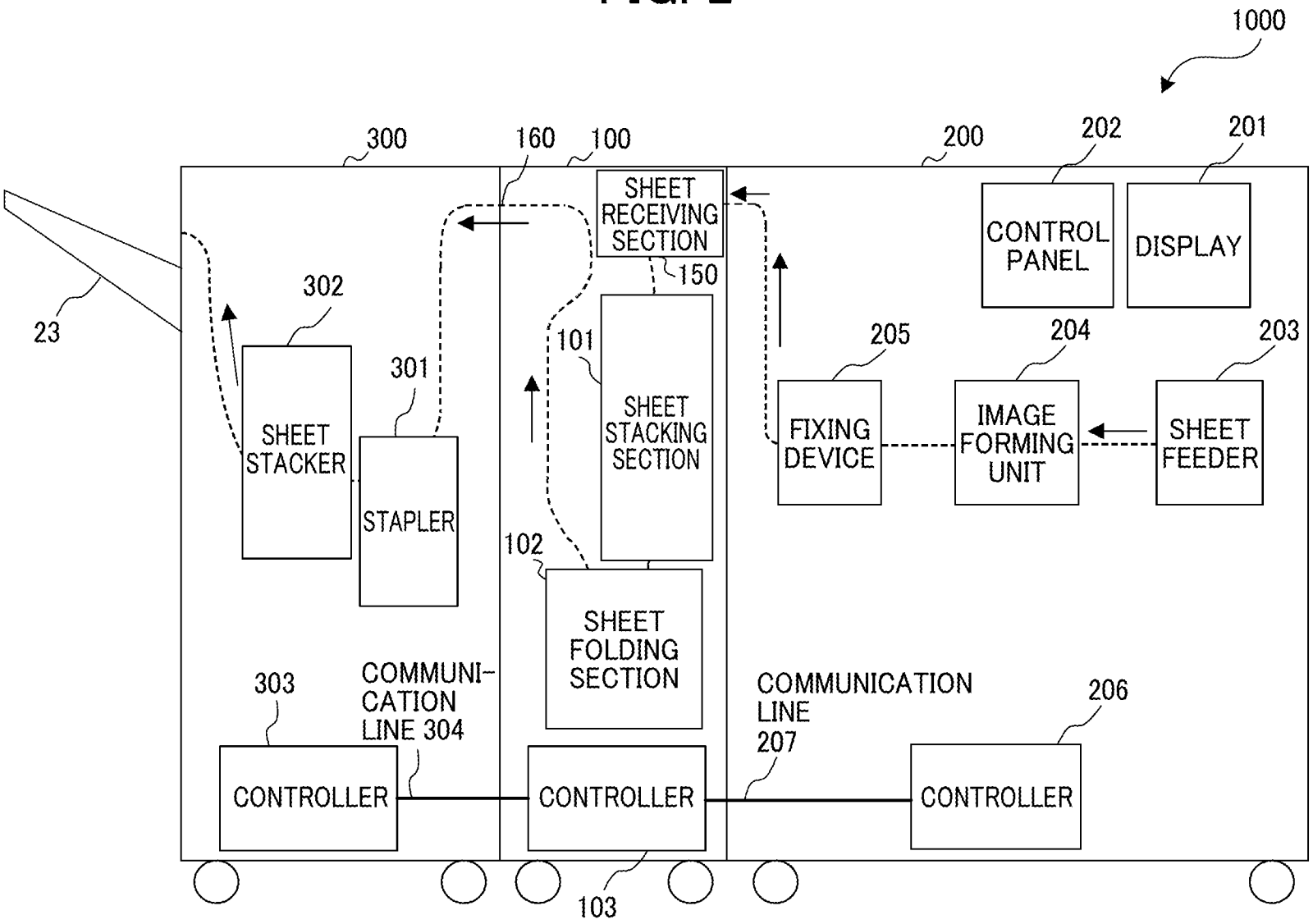
FIG. 2 is a block diagram illustrating an internal configuration of the image forming system illustrated in FIG. 1.

FIG. 2 illustrates a block diagram illustrating an entire configuration of the image forming system 1000. In FIG. 2, a sheet conveyance passage is indicated by a broken line, and a conveyance route is indicated by arrows.

The image forming apparatus 200 is an apparatus that forms an image on a sheet by electrophotography. The image forming apparatus 200 includes a display 201 to notify a user of various states and operation contents of the apparatus, a control panel 202 for the user to set, for example, an operation mode and the number of copies, a sheet feeder 203 to stock sheets and feed the sheets one by one, an image forming unit 204 to forming a latent image on a photoconductor and transferring an image onto a sheet, a fixing device 205 to fix the image transferred onto the sheet, and a controller 206 to controlling each component.

The folding apparatus 100 includes a sheet stacking section 101 (a storing unit) and a sheet folding section 102 (a folding unit). The sheet stacking section 101 temporarily stores (stacks) image-formed sheets conveyed from the image forming apparatus 200 in a multi-sheet fold mode. The sheet folding section 102 performs folding processing for each sheet, or each sheet bundle in the multi-sheet fold mode. The folding apparatus 100 further includes a sheet receiving section 150 to receive sheets from the image forming apparatus 200.

The sheet stacking section 101 temporarily stores the sheets sequentially conveyed from the sheet receiving section 150 to stack a specified number of sheets. The sheet folding section 102 performs sheet folding, which is a main function of the folding apparatus 100.

The folding apparatus 100 further includes a controller 103 to control operations of the sheet receiving section 150, the sheet stacking section 101, and the sheet folding section 102. As will be described later, when the sheet is jammed before reaching the sheet stacking section 101, the controller 103 causes the sheet folding section 102 to fold the sheets stored in the sheet stacking section 101.

The controller 103 and the controller 206 of the image forming apparatus 200 are connected by a communication line 207 to exchange information. With this configuration, information on how to fold the sheets (fold type such as half fold, letter fold-out, letter fold-in, double parallel fold, etc.), sheet size, number of sheets to be bundled (number of sheets specified by a user), timing, and the like are exchanged with the image forming apparatus 200. This enables cooperation between the apparatuses.

The finisher 300 is an apparatus that is coupled on the downstream side of the folding apparatus 100 in the sheet conveyance direction and performs post-processing on the received sheet bundle.

The finisher 300 includes a stapler 301 provided with a sheet stacker 302 to align a bundle of sheets and staples the bundle of aligned sheets. The stapled bundle of sheets is ejected onto an output tray 23. Further, the finisher 300 includes a controller 303 to control the stapler 301 and the sheet stacker 302. The controller 303 and the controller 103 of the folding apparatus 100 are connected by a communication line 304 to exchange information such as information on operation mode, paper size, and operation timing. This enables cooperation between the apparatuses.

Although FIGS. 1 and 2 illustrate an example in which the finisher 300 is on the downstream side of the folding apparatus 100, alternatively, a post-processing apparatus (a stacker, a bookbinding machine, etc.) other than the finisher 300 can be coupled thereto. Yet alternatively, the folding apparatus 100 can be extreme downstream.

Figure 3:
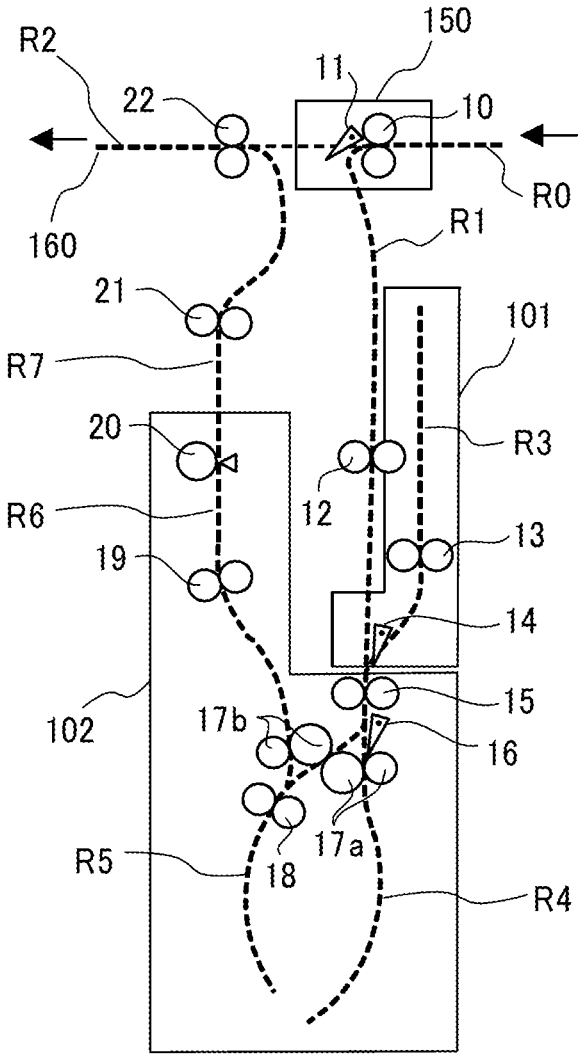
FIG. 3 is a diagram illustrating a conveyance passage of a folding apparatus according to an embodiment.

FIG. 3 is a cross-sectional view of the sheet conveyance passage in the folding apparatus 100. FIG. 3 also illustrates the sheet stacking section 101, the sheet folding section 102, and the sheet receiving section 150 in order to illustrate the correspondence between mechanical components (hardware) such as a roller and functional units illustrated in FIG. 2. The folding apparatus 100 includes conveyors, such as conveyance roller pairs 10, 12, 18, and 19 to convey sheets.

The conveyance roller pair 10 receives the sheet conveyed from the image forming apparatus 200 into the folding apparatus 100. A bifurcating claw 11 switches the conveyance passage to a route R1 leading to the conveyance roller pair 12 when sheet folding is performed, and to a route R2 leading to an ejection roller pair 22 when sheet folding is not performed.

Folding rollers 17 (17*a* and 17*b*) are a group of rollers that perform sheet folding and together serve as a folding device. A conveyance roller pair 19 conveys the sheet folded by the folding rollers 17 (17*a* and 17*b*) to a fold-enforcing roller 20 via a route R6, and the fold-enforcing roller 20 enforces the fold (fold enforcing) on the sheet. The sheet (or sheet bundle) subjected to fold enforcing is conveyed by a conveyance roller pair 21 via a route R7 and is ejected by the ejection roller pair 22 to the finisher 300 on the downstream side. A sheet outlet 160 is provided at the end of the route R2, and the sheet is ejected from the sheet outlet 160 to the outside of the folding apparatus 100.

In this embodiment, the routes R0 to R7 illustrated in FIG. 3 are defined as follows.

The route R0 extends from a sheet inlet of the folding apparatus 100 to the bifurcating claw 11.

The route R1 extends from the bifurcating claw 11 to a bifurcating claw 14.

The route R2 extends from the bifurcating claw 11 to the sheet outlet 160 of the folding apparatus 100.

The route R3 extends from the bifurcating claw 14 to a sheet stacking roller pair 13.

The route R4 extends from the bifurcating claw 14 to the folding rollers 17*a* via a bifurcating claw 16.

The route R5 extends from the bifurcating claw 14 to a conveyance roller pair 18 via the bifurcating claw 16.

The route R6 extends from the folding roller pair 17*b* to the fold-enforcing roller 20.

The route R7 extends from the fold-enforcing roller 20 to the ejection roller pair 22.

To perform multi-sheet fold in which a plurality of sheets is stacked and folded at a time, before the folding process, the sheets are stacked using the sheet stacking roller pair 13 and a peripheral roller for temporarily storing the sheets. For example, the sheet stacking roller pair 13, the peripheral roller, and the route R3 together serve as a stacker. Details of the stacking process and folding process are described below with reference to the drawings.

A description is given in details of the stacking process with reference to FIGS. 4A to 4D.

Figure 4A:
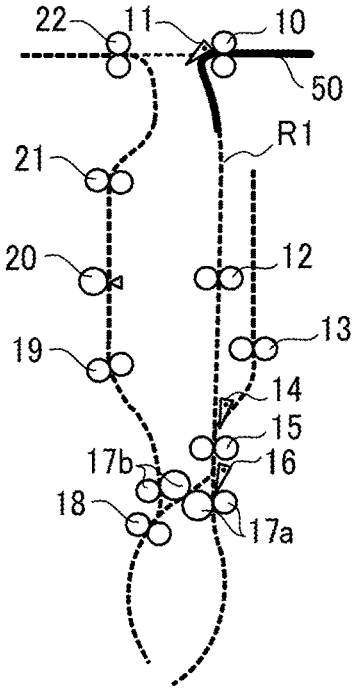
FIGS. 4A to 4D illustrate a stacking process in the folding apparatus illustrated in FIG. 3.

The conveyance roller pair 10 receive a sheet 50 one by one from the route R0, and the bifurcating claw 11 switches the conveyance passage to forward a first sheet to the route R1 (FIG. 4A). At this time, the controller 103 acquires information indicating that the folding process is performed from the controller 206 of the image forming apparatus 200, and controls the rotation of the bifurcating claw 11 based on this information.

Figure 4B:
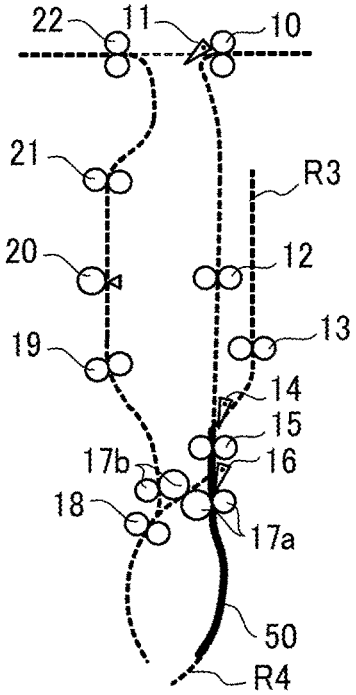

The sheet 50 is conveyed toward the route R4. When the trailing end of the sheet 50 passes through the bifurcating claw 14, the bifurcating claw 14 rotates to switch the direction of conveyance of the sheet 50, and the rollers (here, a registration roller pair 15 and the folding rollers 17*a*) rotate in reverse to perform switchback (FIG. 4B).

Figure 4C:
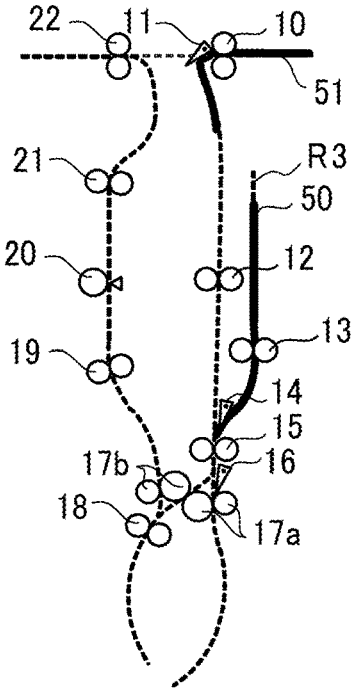

The reversed sheet 50 is conveyed toward the route R3, and the sheet stacking roller pair 13 conveys the sheet 50 to a position where the entire sheet 50 passes through the registration roller pair 15. Then, the sheet 50 waits for arrival of a next sheet 51 from the route R0 (FIG. 4C).

Figure 4D:
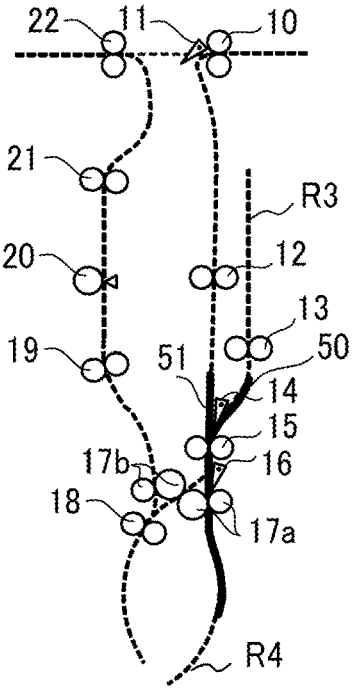

The first sheet 50 is conveyed toward the registration roller pair 15 to coincide with arrival of the leading end of the second sheet 51 at the registration roller pair 15. As a result, the first sheet 51 and the second sheet 51 overlap with each other (FIG. 4D).

When stacking three or more sheets, at the timing when the trailing ends of the two stacked sheets 50 and 51 pass through the bifurcating claw 14 (see FIG. 4B), switchback is again performed. Then, the bifurcating claw 14 is switched to retract the sheets 50 and 51 to the route R3 on the sheet stacking roller pair 13 side (FIG. 4C). This operation is repeated according to the number of sheets to be stacked, to stack the sheets.

Next, the folding process is described. First, an operation to perform letter fold-out (Z-folding) is described with reference to FIGS. 5A to 5D. A description is given of the operation to fold a single sheet in letter fold-out.

Figure 5A:
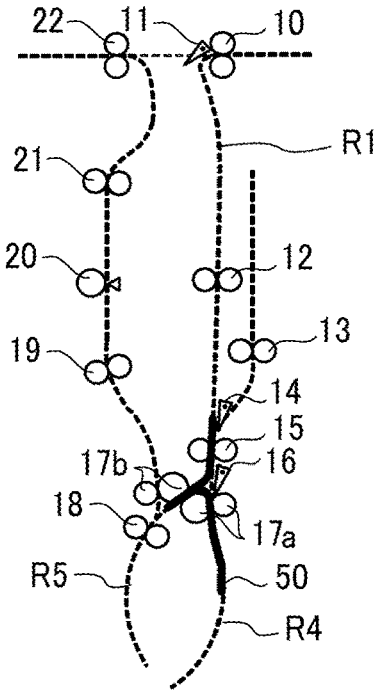
FIGS. 5A to 5D illustrate an operation for Z-fold-out or letter fold-out in the folding apparatus.

The sheet 50 is conveyed to the route R4 by the registration roller pair 15 and the folding rollers 17*a*. Then, only the folding rollers 17*a* rotate in reverse at the timing when the leading end of the sheet 50 is conveyed to the predetermined position on the route R4. As a result, the sheet 50 is slackened. The slack thereof enters the route R5, and the folding rollers 17 (17*a* and 17*b*) perform a first folding process (FIG. 5A).

Figure 5B:
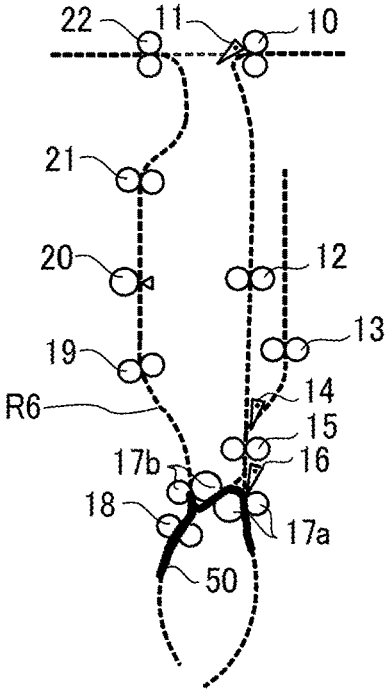

The sheet 50 that has been subjected to the first folding process is conveyed by the folding rollers 17 (17*a* and 17*b*) and the conveyance roller pair 18 downstream along the route R5. Then, at the timing when the leading end of the sheet 50 is conveyed to a predetermined position on the route R5, only the conveyance rollers 18 rotate in reverse. As a result, the sheet 50 is slackened. The slack thereof enters the route R6, and the folding rollers 17*b* perform a second folding process (FIG. 5B). In the second folding process, the sheet is folded in reverse to the folding in the first folding process described above (when mountain fold is performed in the first folding process, valley fold is performed in the second folding process).

Figure 5C:
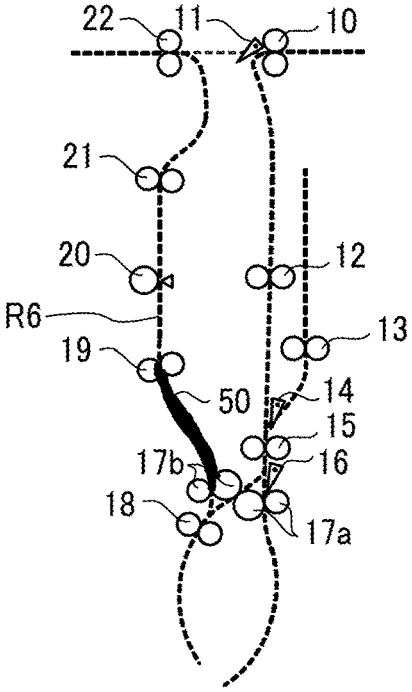

The sheet 50 that has been subjected to the second folding process is conveyed by the conveyance roller pair 19 and advances along the route R6 (FIG. 5C). When the leading end of the sheet 50 reaches the fold-enforcing roller 20, the sheet 50 is temporarily stopped.

Figure 5D:
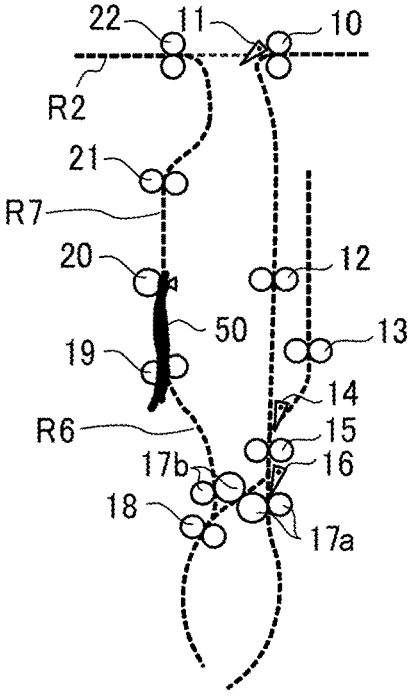

When the fold-enforcing roller 20 rotates with respect to the leading end of the stopped sheet 50, the fold is enforced, that is, additional folding is performed (FIG. 5D). The fold is reinforced by the amount of rotation of the fold-enforcing roller 20. As the fold-enforcing roller 20 rotates a prescribed number of times, the sheet 50 is conveyed by the distance to the next fold (the length between the folds in the sheet conveyance direction), and then the fold enforcing of the next fold is performed. After the fold enforcing of the next fold, conveyance of the sheet 50 is resumed, and the sheet 50 is ejected from the sheet outlet 160 to the outside of the folding apparatus 100 via the routes R7 and R2.

Although the description above concerns the folding of a single sheet, the folding of a sheet bundle after stacking the sheets can be performed by combining the operations described with reference to FIGS. 4A to 4D.

A description is given of an operation to perform half fold with reference to FIGS. 6A to 6D. The description below concerns an operation to fold a single sheet in half fold.

Figure 6A:
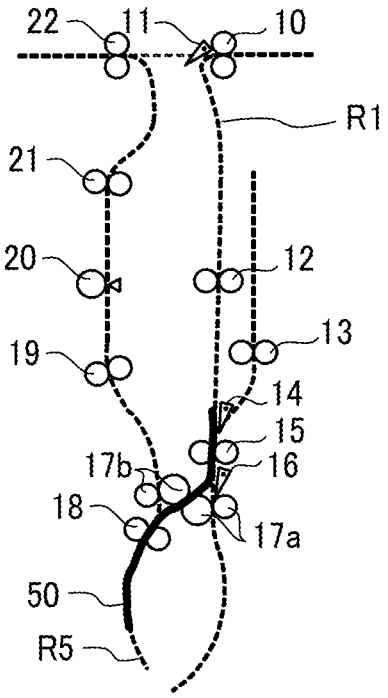
FIGS. 6A to 6D illustrate an operation for half fold in the folding apparatus.

The controller 103 controls the orientation of the bifurcating claw 16, and the sheet 50 enters the route R5 conveyed by the registration roller pair 15, the folding rollers 17 (17*a* and 17*b*), and the conveyance roller pair 18 (FIG. 6A).

Figure 6B:
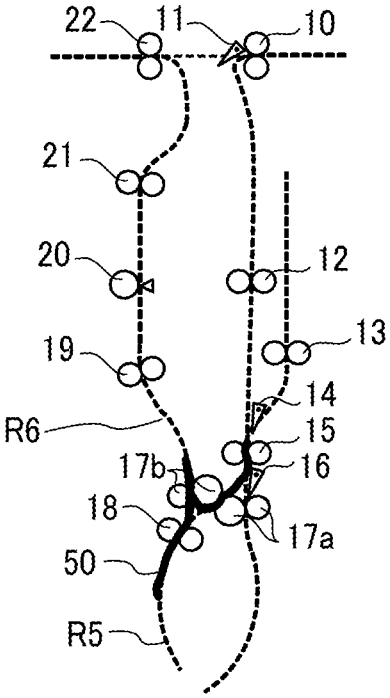
Figure 6C:
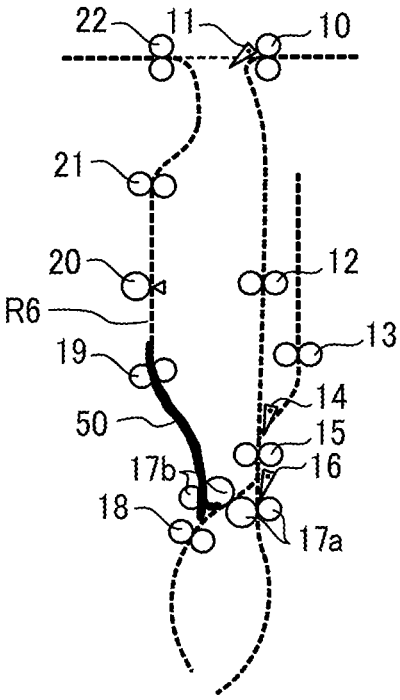

At the timing when the leading end of the sheet 50 reaches the predetermined position on the route R5, only the folding rollers 17*b* and the conveyance roller pair 18 rotates in reverse. As a result, the sheet 50 is slackened. The slack thereof enters the route R6, and the folding rollers 17*b* perform a folding process (FIG. 6B).

The sheet 50 thus folded is conveyed along the route R6 by the conveyance roller pair 19 (FIG. 6C) and is stopped at the position where the leading end thereof reaches the fold-enforcing roller 20.

Figure 6D:
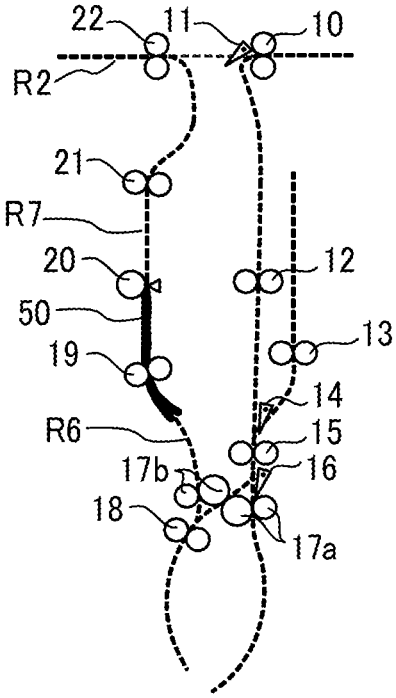

When the fold-enforcing roller 20 rotates with respect to the stopped sheet 50, the fold is enforced, that is, additional folding is performed (FIG. 6D). After the fold-enforcing roller 20 rotates by the predetermined number of times, conveyance of the sheet 50 is resumed. The sheet 50 is ejected from the sheet outlet 160 to the outside of the folding apparatus 100 via the routes R7 and R2. In the case of half-fold, fold enforcing of the trailing end of the sheet is not performed.

Although the description above concerns the folding of a single sheet, the folding of a sheet bundle after stacking the sheets can be performed by combining the operations described with reference to FIGS. 4A to 4D.

Figure 7:
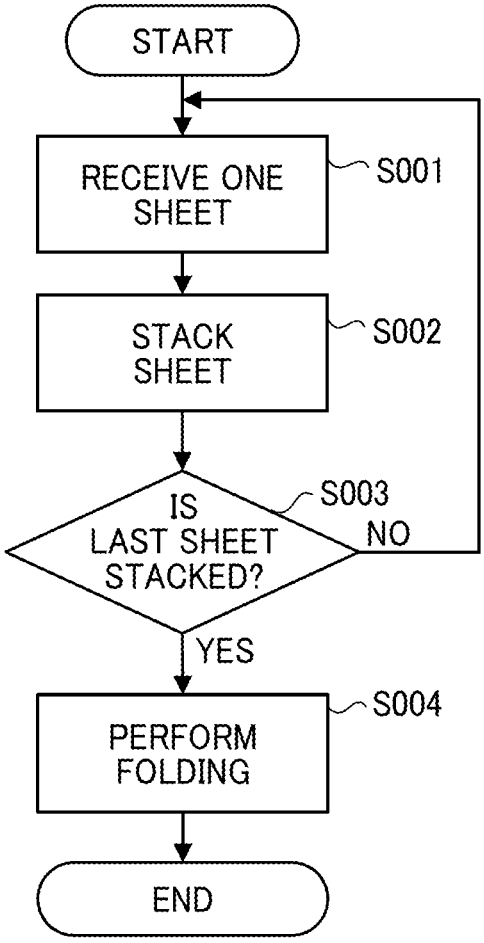
FIG. 7 is a flowchart illustrating an operation for multi-sheet fold in the folding apparatus.

FIG. 7 is a flowchart illustrating the operation for multi-sheet fold. The controller 103 of the folding apparatus 100 acquires in advance job information for performing multi-sheet fold from the controller 206 of the image forming apparatus 200 via the communication line 207. As a result, information on, for example, the number of sheets to be stacked in one bundle, the size of the sheets, and the type of folding such as half fold or tri-fold (Z-fold) is transmitted to the controller 103 of the folding apparatus 100 in advance.

The sheet receiving section 150 receives one sheet conveyed from the image forming apparatus 200 (S001). The sheet stacking section 101 sequentially receives the sheets received in S001, and performs the above-described stacking process for temporarily storing the sheets (S002).

The controller 103 determines whether the sheet that has been stacked is the last sheet, that is, the number of sheets stacked is equal to the number of the last sheet (S003). In the case of the last sheet, the sheet folding section 102 folds the stacked sheets including the last sheet (S004) together. Then, the controller 103 ejects the folded sheets outside the folding apparatus 100, and ends the job. When the sheet is not the last sheet (S003: No), the process returns to S001, and the sheet receiving section 150 receives the subsequent sheet.

The above description with reference to FIGS. 4A to 7 concerns a normal operation in which a sheet jam (also simply referred to as a jam) does not occur. A description is given below of an operation at the occurrence of a jam in the middle of a job in the folding apparatus 100 according to the present embodiment.

Figure 8A:
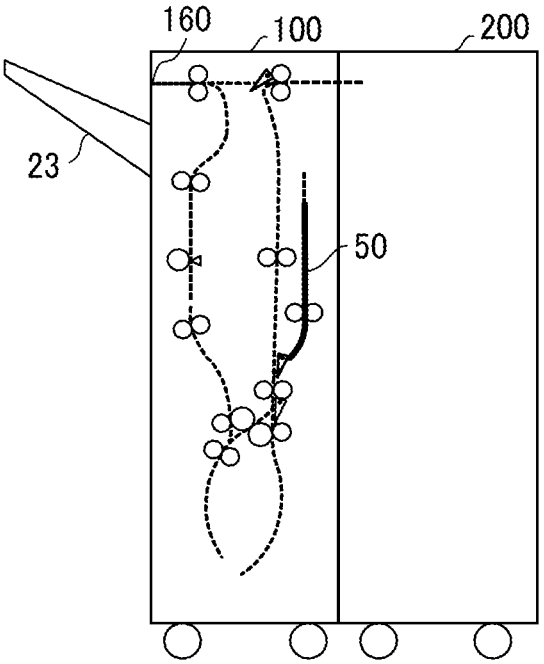
FIGS. 8A, 8B, and 8C are views illustrating an operation at the occurrence of a jam on an upstream side of the folding apparatus.
Figure 8B:
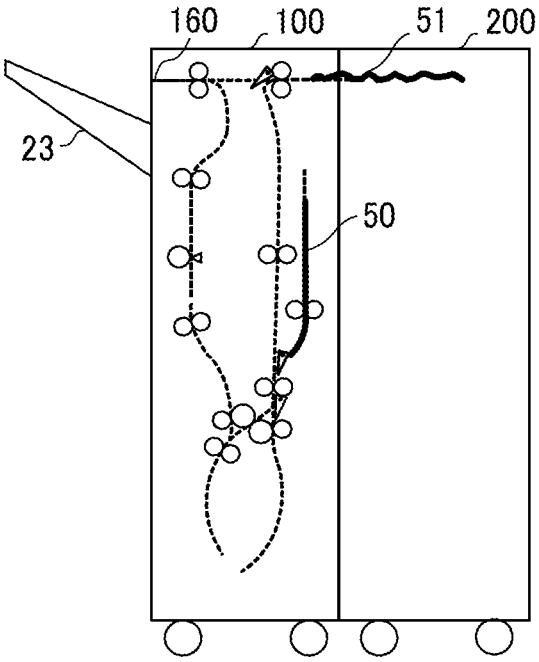
Figure 8C:
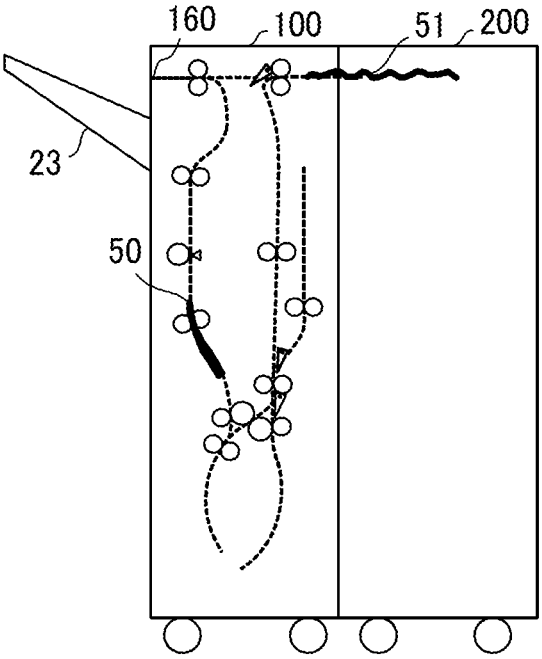

FIGS. 8A, 8B, and 8C are views illustrating an operation at the occurrence of a jam in the sheet receiving section 150 illustrated in FIG. 3. In the following, for simplification, a description is given of a case where the folding apparatus 100 is on the extreme downstream and the finisher 300 is not connected.

In FIG. 8A, in a state where the bundle of sheets 50 is stacked in the sheet stacking section 101, the sheet receiving section 150 receives a subsequent sheet, which is referred to as the sheet 51 (FIG. 8A).

The sheet 51 is jammed astride the sheet ejection section of the image forming apparatus 200 and the sheet receiving section 150 of the folding apparatus 100 (FIG. 8B). The controller 206 of the image forming apparatus 200 detects the jam and transmits the information to the controller 103 of the folding apparatus 100. Alternatively, the controller 103 of the folding apparatus 100 can be configured to detect a jam.

The folding apparatus 100 to which the jam information has been transmitted ejects the sheet or sheet bundle (e.g., the bundle of sheets 50) that has not been folded from the sheet stacking section 101. Then, the sheet folding section 102 folds the ejected sheet or sheet bundle by the method described above (FIG. 8C). Then, the folded bundle of sheets 50 is conveyed to a predetermined position where the user can easily remove the bundle of sheets 50 (a take-out position to be easily accessed by the user) and stopped. Thus, the sheet or the sheet bundle (e.g., the bundle of sheets 50) in the middle of processing other than the jammed sheet 51 is conveyed to the position where the sheet or the sheet bundle can be easily taken out. Therefore, the user can easily perform restoration work from the jam.

There may be a folding apparatus in which, when a jam occurs, the bundle of sheets 50 in the sheet stacking section 101 is not conveyed, and the user has to remove the bundle of sheets 50, as invalid sheets, from the sheet stacking section 101. However, the sheet stacking section 101 is disposed in a narrow space because of a layout constraint that the sheet stacking section 101 is between the sheet inlet (the sheet receiving section 150) and the sheet folding section 102. Therefore, removal of the sheet is performed in a narrow space. Further, since the sheets stacked in the sheet stacking section 101 have not been folded yet, the user needs to remove the sheets in a long state, and the workability is low.

In the present embodiment, as described above, the bundle of sheets 50 stacked is conveyed from the sheet stacking section 101 and folded. Accordingly, the sheet length in the sheet conveyance direction of the bundle of sheets 50 is reduced. Then, the controller 103 controls the sheet conveyance so that the bundle of sheets 50 is conveyed to a predetermined position (where the space for removing is relatively large) suitable for removal of sheets by the user. Therefore, the user can remove the sheets in short state in the space sufficient in size for removal work, and the workability is improved.

The operation example (a first operation example) illustrated in FIGS. 8A to 8C is described with reference to the flowchart in FIG. 9.

In S101, the controller 103 determines whether or not a jam has occurred in the sheet receiving section 150. In response to the information indicating the occurrence of a jam from the image forming apparatus 200 (S101: Yes), the controller 103 determines whether or not there is any sheet in the sheet stacking section 101 (S102). Specifically, for example, the sheet stacking section 101 is provided with a sensor to detect a sheet, and the determination is made based on the detection by the sensor. Alternatively, the number of sheets conveyed to the sheet stacking section 101 is counted, and the controller 103 determines that one or more sheets are in the sheet stacking section 101 when the count number is 1 or more.

In response to a determination that no sheet is in the sheet stacking section 101 (S102: No), the controller 103 advances the processing to S108. In response to a determination that one or more sheets are in the sheet stacking section 101 (S102: Yes), the controller 103 controls to the conveyors to convey the sheets (or the sheet bundle) stacked in the sheet stacking section 101 to the sheet folding section 102. Then, the sheet folding section 102 performs the folding process (S103). Hereinafter, although the sheet conveyed from the sheet stacking section 101 to the sheet folding section 102 is in the singular form, the number of sheets may be two or more. When the folding process is completed (S104: Yes), the controller 103 starts sheet conveyance (S105). The controller 103 keeps conveying the sheet until the sheet is conveyed by a predetermined distance (a loop of No in S106). In response to a determination that the sheet has been conveyed by the predetermined distance (S106: Yes), the controller 103 stops the conveyance (S107).

In S108, the controller 103 reports the occurrence of the jam and prompts the user to perform the recovery work from the jam. As the report of the occurrence of the jam, the controller 103 transmits information indicating the occurrence of the jam to the controller 206 of the image forming apparatus 200 via the communication line 207, and the controller 206 indicates the occurrence of the jam on the display 201.

Other operation examples are described below. FIG. 10 is a flowchart illustrating a second operation example at the occurrence of a jam. The main flow of the process is the same as in FIG. 9, but the process in FIG. 10 is different from the process in FIG. 9 in that the folding method of the stacked sheets is changed from the folding method designated by the user.

Figure 9:
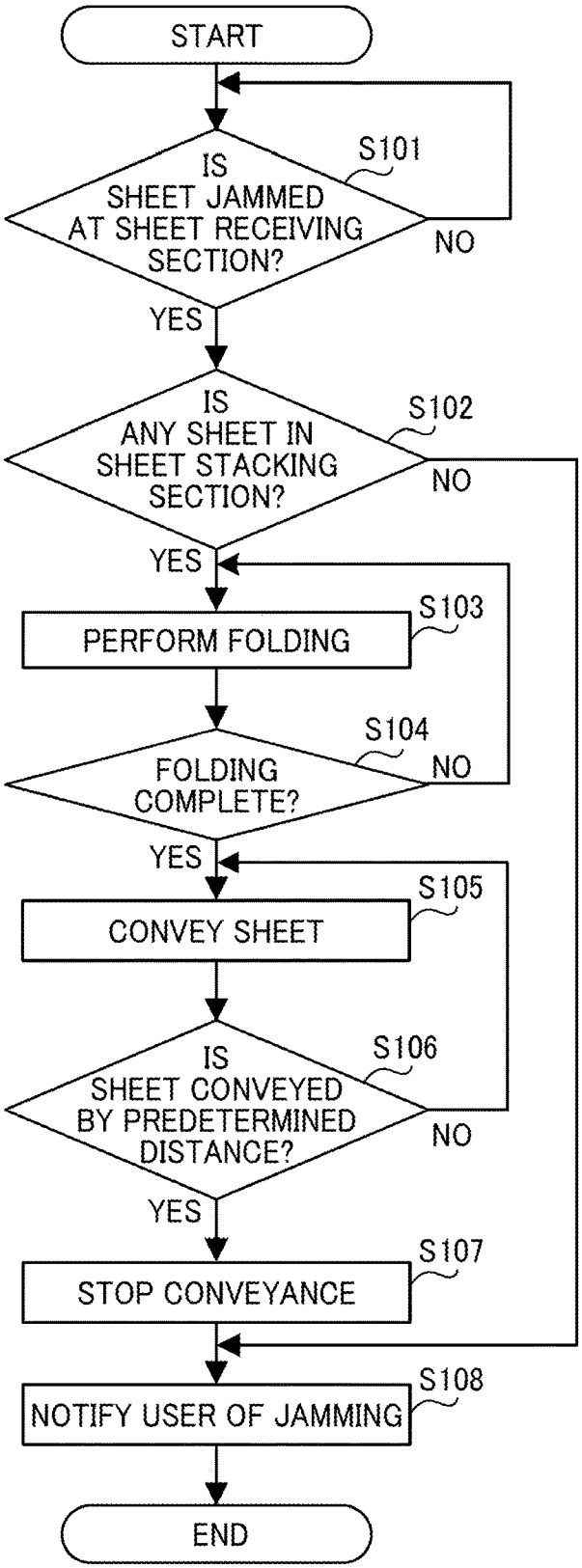
FIG. 9 is a flowchart illustrating a first operation example at the occurrence of a jam on the upstream side of the folding apparatus.
Figure 10:
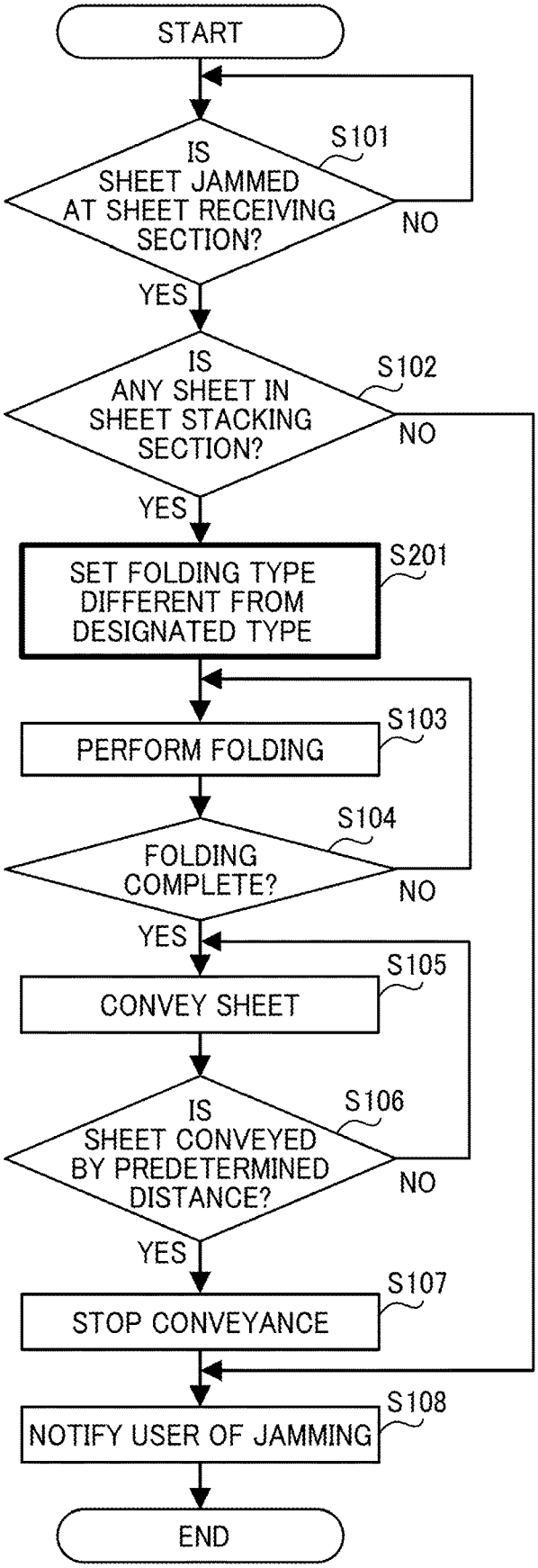
FIG. 10 is a flowchart illustrating a second operation example at the occurrence of a jam on the upstream side in the folding apparatus.

The process up to S102 is the same as that in the flowchart in FIG. 9. In the example in FIG. 10, in S201, the controller 103 newly sets the folding method to a folding method different from the folding method designated by the user (folding method designated in the print job information). For example, when the folding method designated by the user is Z-fold, the controller 103 changes the folding method setting to half fold or double parallel fold. Alternatively, when the designated folding method is half fold, the controller 103 changes the folding method setting to Z-fold or double parallel fold. As a result, the sheet folding section 102 folds the sheets stacked in the sheet stacking section 101 in the renewed folding method (S103). Subsequent operations are the same as those in the flowchart in FIG. 9.

During executing of a job in which the user designates multi-sheet fold, when a jam occurs immediately before the last sheet, the sheet or sheet bundle in the sheet stacking section 101 is an unfinished product and invalid. However, there is a risk that the user mistakes the unfinished product lacking a sheet for a finished product when taking out the bundle of folded sheets 50 if the sheets 50 are folded in the folding method designated by the user. In the example in FIG. 10, in the job that has experienced a jam, the sheets are folded in the type different from the folding method designated by the user (unfinished sheet bundle). Therefore, there is no risk of mistaking the unfinished sheet bundle for a finished sheet bundle.

Figure 11:
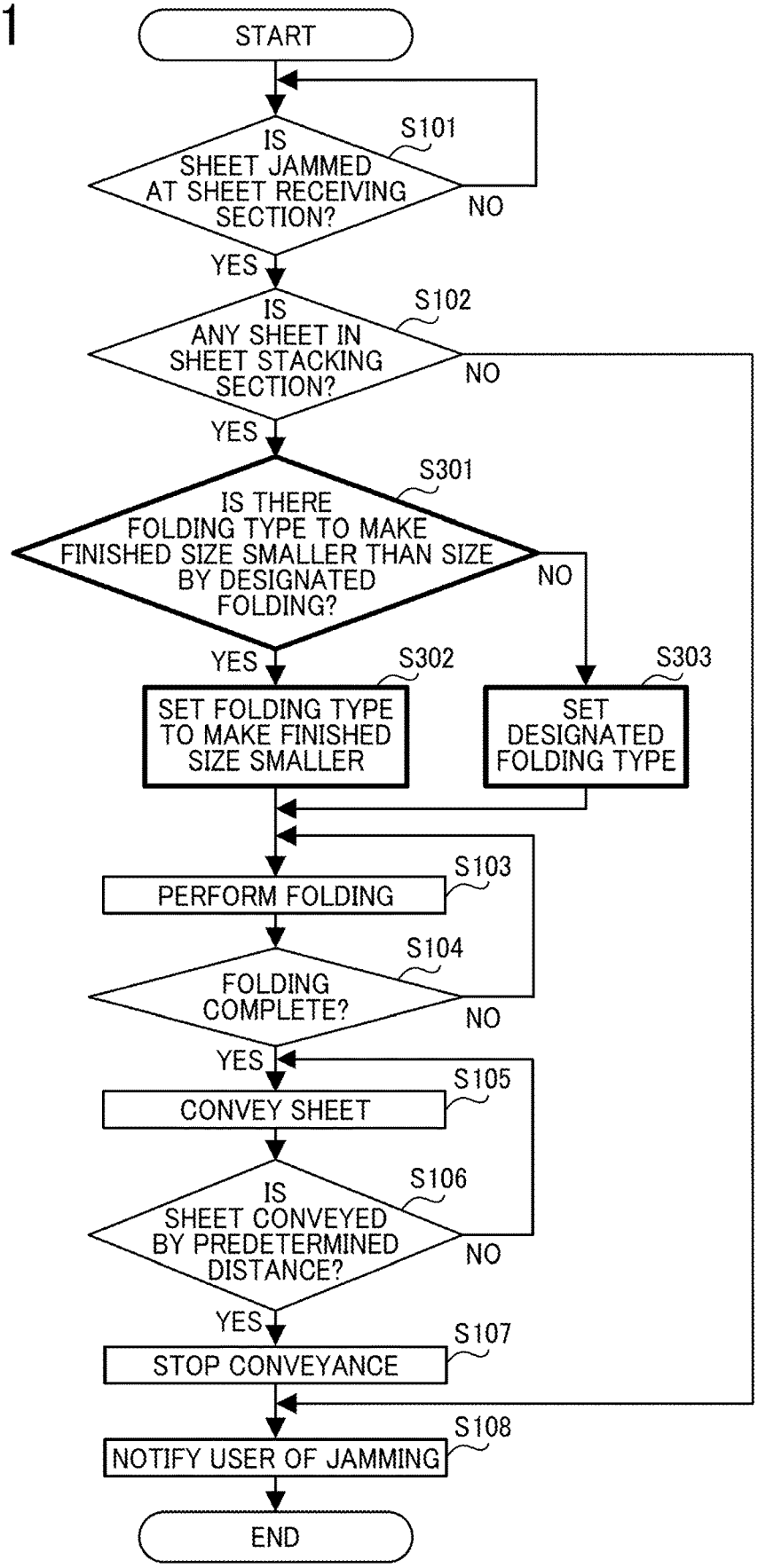
FIG. 11 is a flowchart illustrating a third operation example at the occurrence of a jam on the upstream side in the folding apparatus.

FIG. 11 is a flowchart illustrating a third operation example at the occurrence of a jam. The main flow of the process is the same as in FIG. 9, but the process in FIG. 11 is different from the process in FIG. 9 in that the folding method of the stacked sheets is changed to make the finished size of folded sheets smaller.

The process up to S102 is the same as the flowchart in FIG. 9. In response to a determination that one or more sheets are in the sheet stacking section 101, the controller 103 determines whether there is any selectable folding method that makes the finished size (folded sheet size) shorter in the sheet conveyance direction than the finished size by the folding method designated by the user (S301). When the folding method designated by the user is, for example, half fold, the controller 103 determines whether a Z-fold (letter fold-out or letter fold-in) or double parallel fold that reduce the finished size in the sheet conveyance direction is selectable.

When the folding method that makes the finished size shorter is selectable (S301: Yes), the controller 103 sets the selectable folding method (S302). When there is a plurality of selectable types, the folding method that makes the finished size shorter or the folding method that is lowest in processing load is set. When there is no folding method that makes the finished size shorter (S301: No), the controller 103 sets the initial folding method designated by the user (S303). After that, the sheet folding section 102 folds the sheets stacked in the sheet stacking section 101 in the set folding method (S103). Subsequent operations are the same as those in the flowchart in FIG. 9.

By the operation in FIG. 11, for example, when the user designates half fold, the folding process for letter fold-out, letter fold-in, double parallel fold, etc. to reduce the finished sizer from the finished size by half hold is performed. When the user removes the sheet bundle in recovery from the jam, removal of the sheets folded in Z-fold or double parallel fold that is shorter in the sheet conveyance direction is easier compared with half fold.

FIGS. 12A to 12D are views of the folding apparatus 100 illustrating a specific example of the position at which the conveyance of the bundle of sheets 50 (invalid sheet) is stopped when a jam occurs in the sheet receiving section 150. In the following, similarly, for simplification, a description is given of a case where the folding apparatus 100 is on the extreme downstream and the finisher 300 is not connected.

Figure 12A:
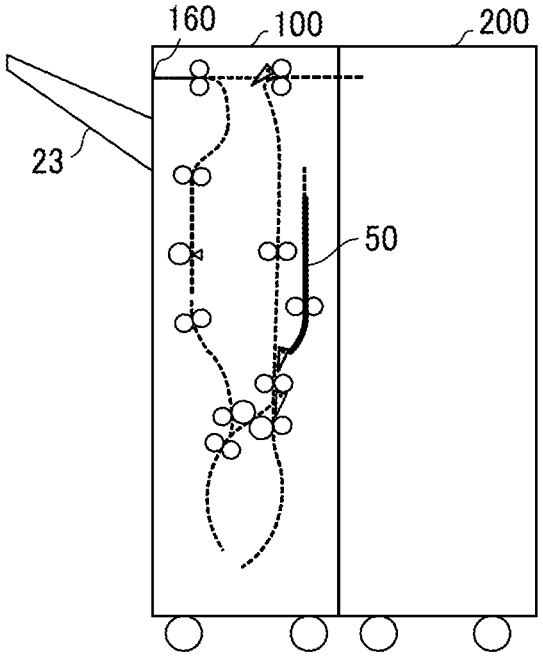
FIGS. 12A to 12D are views illustrating an operation to expose a sheet bundle from a sheet outlet of the folding apparatus at the occurrence of a jam on the upstream side of the folding apparatus.

In FIG. 12A, in the state where the bundle of sheets 50 is stacked in the sheet stacking section 101, the folding apparatus 100 receives the next sheet, the sheet 51 (FIG. 8A).

Figure 12B:
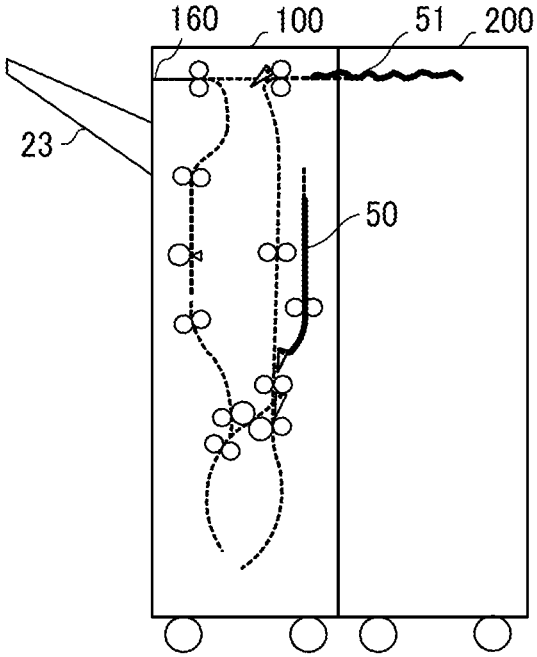

The sheet 51 is jammed astride the sheet ejection section of the image forming apparatus 200 and the sheet receiving section 150 of the folding apparatus 100 (FIG. 12B). Similar to the example illustrated in FIGS. 8A to 8C, the controller 206 of the image forming apparatus 200 detects the jam and transmits the information to the controller 103 of the folding apparatus 100.

Figure 12C:
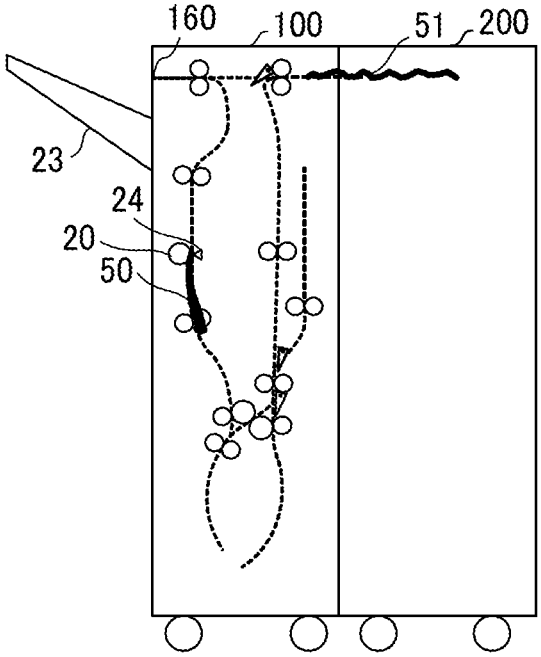
Figure 12D:
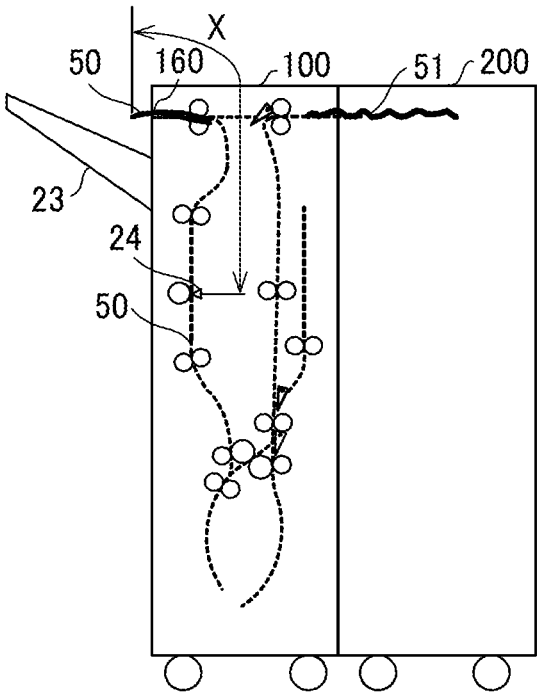

The folding apparatus 100 to which the jam information has been transmitted ejects the bundle of sheets 50 not yet folded from the sheet stacking section 101. Then, the sheet folding section 102 folds the ejected sheet bundle by the method described above. Then, the bundle of folded sheets 50 is conveyed, and the leading end thereof reaches a timing sensor 24 disposed at a predetermined position (FIG. 12C). The bundle of sheets 50 is conveyed to the sheet outlet 160 without fold-enforcing. Note that, in the example in FIG. 12C, the timing sensor 24 is a sensor disposed near the fold-enforcing roller 20 to detect entry of the sheet bundle into the fold-enforcing roller 20, but the timing sensor 24 is not limited thereto.

The controller 103 starts measuring the amount of conveyance (conveyed length) from when the leading end of the bundle of sheets 50 reaches the timing sensor 24. When the amount of conveyance reaches a predetermined amount of conveyance X, the controller 103 controls the conveyance rollers to stop the conveyance. The amount of conveyance X corresponds to a position where the leading end of the bundle of sheets 50 slightly protrudes (about 20 to 30 mm) from the sheet outlet 160 of the folding apparatus 100 and is exposed. The user can visually recognize the bundle of sheets 50 that is stopped in a state not fully ejected to the output tray 23 at the time of recovery from the jam. Thus, the user can notice the invalid sheets. Since the leading end of the bundle of sheets 50 is exposed from the apparatus through the sheet outlet 160, opening a cover or the like is not necessary. The user can grasp the leading end of the ejected bundle of sheets 50 by hand and pull the bundle. Thus, recovery from the jam is easy. The amount of conveyance of the bundle of sheets 50 is not limited thereto. Alternatively, the bundle of sheets 50 can be conveyed to be fully ejected from the sheet outlet 160 or conveyed to a position where the inside of the conveyance passage is opened.

When the system configuration is changed and the finisher 300 is coupled to the downstream side of the folding apparatus 100, the control can be changed to stop the bundle of sheets 50 at a position where the leading end of the bundle of sheets 50 protrudes from the sheet outlet of the finisher 300.

Figure 13:
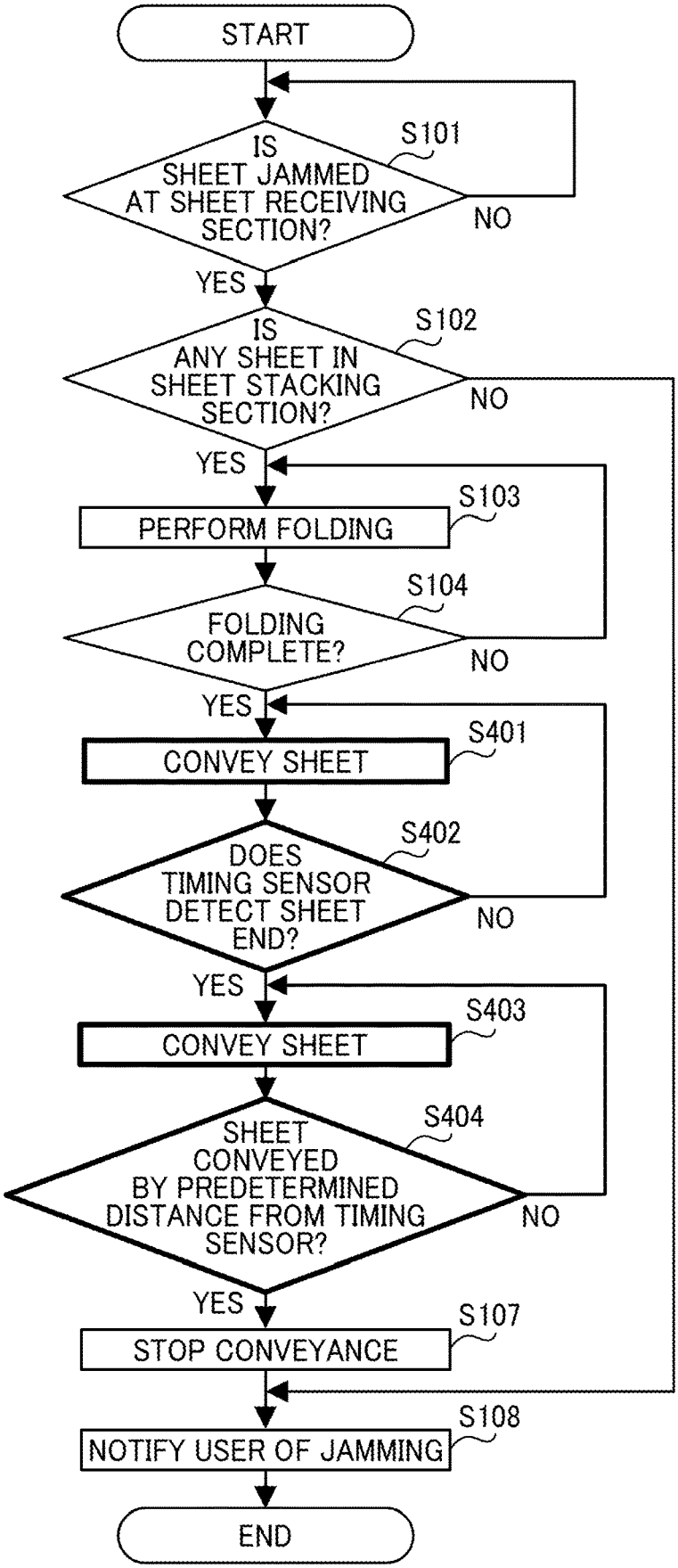
FIG. 13 is a flowchart illustrating the operation corresponding to FIGS. 12A to 12D.

FIG. 13 is a flowchart illustrating the operation example described with reference to FIGS. 12A to 12D. The process up to S104 is the same as that in the flowchart in FIG. 9.

After the sheet conveyance is started, the controller 103 keeps conveying the bundle of sheets 50 until the timing sensor 24 detects the bundle (a loop of S401 and No in S402).

When the timing sensor 24 detects the leading end of the bundle of sheets 50 (S402: Yes), the controller 103 starts measuring the amount of conveyance. Then, the controller 103 continues the conveyance until the amount of conveyance (conveyed length) from the timing sensor 24 reaches the predetermined amount of conveyance X (a loop of S403 and S404: No).

The controller 103 stops the conveyance after the amount of conveyance reaches the predetermined distance (amount of conveyance X) from when the timing sensor 24 detects the sheet bundle (S107). After stopping the conveyance of the sheet bundle, the controller 103 notifies the user of the occurrence of the jam (S108) and prompts the user to perform recovery from the jam.

Figure 14:
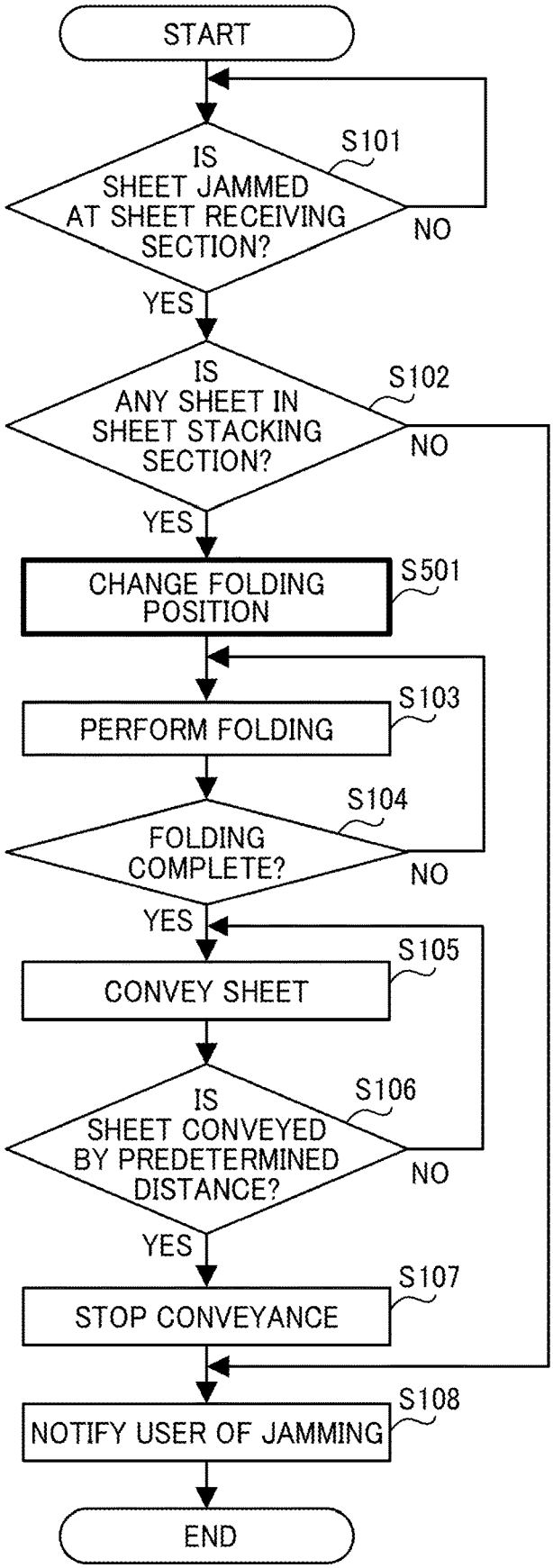
FIG. 14 is a flowchart illustrating a fourth operation example at the occurrence of a jam on the upstream side of the folding apparatus.

The operation examples described above with reference to FIGS. 10 and 11 concern changing the folding method of the invalid sheets stacked in the sheet stacking section 101 from the folding method designated by the user. Further, another operation example (a fourth example) is described with reference to the flowchart in FIG. 14.

The process up to S102 is the same as the flowchart in FIG. 9. Regarding the bundle of sheets 50 stored in the sheet stacking section 101, the controller 103 changes the folding position from the position of the folding method designated by the user (S501). After that, the sheet folding section 102 folds the bundle of sheets 50 at the set folding position (S103). Subsequent flow of operations is the same as that in the flowchart in FIG. 9.

Folding the sheet at a position different from the position of the folding method designated by the user is advantageous in that the distinguishing the valid sheet and the invalid sheet becomes easy, thereby eliminating the risk of mistaking. Examples of changing the folding position setting of the sheet are described with reference to FIGS. 15A to 15E, using half-fold and half accordion fold (letter fold-out) as examples.

Figure 15A:
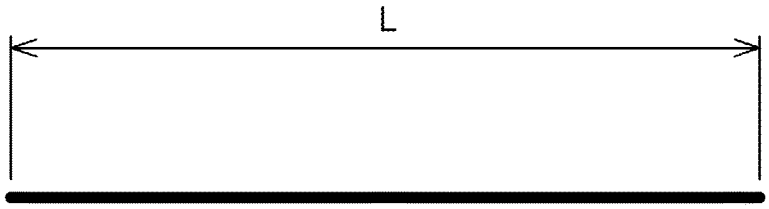
FIGS. 15A to 15E are views illustrating examples of folding positions at the occurrence of a jam in the folding apparatus.
Figure 15B:
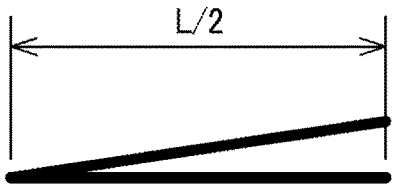
Figure 15C:
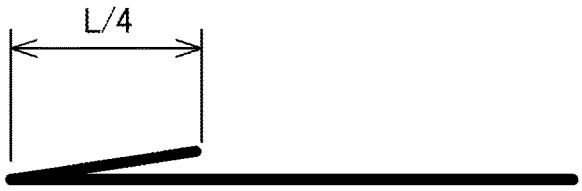

When the sheet as is (before folding) has a length L in the sheet conveyance direction as illustrated in FIG. 15A, the sheet is folded at half the sheet length L (L/2) in the normal setting of half-fold as illustrated in FIG. 15B. On the other hand, in the example of the flowchart in FIG. 14, the invalid sheet after the occurrence of jam is folded, for example, at one fourth of the length L (L/4) as illustrated in FIG. 15C.

Figure 15D:
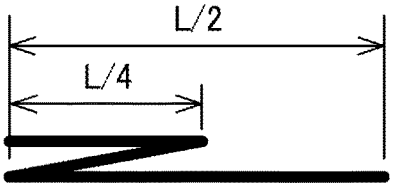
Figure 15E:
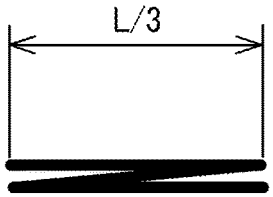

In the normal setting of half accordion fold illustrated in FIG. 15D, the sheet is folded at half the length L (L/2) and folded further at half the length L/2 (L/4). On the other hand, in the example of the flowchart in FIG. 14, the invalid sheet after the occurrence of jam is folded, for example, evenly at one third of the length L (L/3) at two positions as illustrated in FIG. 15E.

As a result, the invalid sheet after the occurrence of jam is obviously different from the valid sheet finished in the normal folding type, so that there is no risk that the user mistakes the invalid sheet for the valid sheet. The folding positions illustrated in FIGS. 15A to 15E are examples. It is sufficient that a sheet bundle that have experienced a jam is folded at a position different from the folding position in a case where the jam does not occur.

In the above description, the location of the jam is the sheet receiving section 150 that is the connection portion with the image forming apparatus 200, but the above-described aspects of this disclosure can be adapted to a case of a jam occurs in a period of time to when the leading end of the sheet reaches the sheet stacking section 101, that is, a case of jam occurring upstream from the bifurcating claw 14 in the conveyance passage. Even when a jam occurs in the image forming apparatus 200, the aspect of this disclosure can be adapted because at least the leading end of the sheet is in the section upstream from the sheet stacking section 101.

According to an aspect of this disclosure, when a jam occurs, the sheets stacked in the sheet stacking section are folded to reduce the sheet length in the sheet conveyance direction from the original length (the state in FIG. 15A). Accordingly, the workability of recovering from the jam can improve. In addition, the sheet in the sheet stacking section that needs to be removed in the recovery from the jam can be moved from the restricted sheet stacking section to a wider space from which the removal is easier. Thus, removal of the sheets becomes easy.

As described above, an aspect of each embodiment described above can improve the workability of recovery from the occurrence of a sheet jam.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A folding apparatus configured to stack and fold a designated number of sheets at a time, the folding apparatus comprising:

a conveyor configured to sequentially convey the designated number of sheets;

a stacker configured to temporarily store a sheet conveyed by the conveyor to stack the designated number of sheets;

a sheet folding device configured to fold the designated number of sheets at a time; and control circuitry configured to cause the sheet folding device to fold the stored sheet in response to an occurrence of a sheet jam in processing the designated number of sheets, the sheet jam occurring upstream from the stacker in a direction of sheet conveyance, set a first folding method in response to the occurrence of the sheet jam, the first folding method different from a second folding method for a case free from a sheet jam, and cause the sheet folding device to fold the stored sheet in the first folding method.

2. The folding apparatus according to claim 1, wherein the first folding method is to reduce a finished length of the folded sheet in the direction of sheet conveyance from a finished length of a folded sheet by the second folding method.

3. The folding apparatus according to claim 1, wherein the control circuitry is configured to cause the conveyor to convey, to a removal position, the sheet folded by the sheet folding device in response to the occurrence of the sheet jam, the removal position to be accessed by a user.

4. The folding apparatus according to claim 3, wherein the removal position is a sheet outlet of the folding apparatus.

5. An image forming system comprising:

an image forming apparatus configured to form an image on a sheet; and the folding apparatus according to claim 1, configured to fold the sheet on which the image is formed by the image forming apparatus.

6. A folding apparatus configured to stack and fold a designated number of sheets at a time, the folding apparatus comprising:

a conveyor configured to sequentially convey the designated number of sheets;

a stacker configured to temporarily store a sheet conveyed by the conveyor to stack the designated number of sheets;

a sheet folding device configured to fold the designated number of sheets at a time; and control circuitry configured to cause the sheet folding device to fold the stored sheet in response to an occurrence of a sheet jam in processing the designated number of sheets, the sheet jam occurring upstream from the stacker in a direction of sheet conveyance, set a first folding position in response to the occurrence of the sheet jam, the first folding position different from a second folding position for a case free from a sheet jam; and cause the sheet folding device to fold the stored sheet at the first folding position.

7. The folding apparatus according to claim 6, wherein the first folding position is to reduce a finished length of the folded sheet in the direction of sheet conveyance from a finished length of the sheet folded at the second folding position.

8. The folding apparatus according to claim 6, wherein the control circuitry is configured to cause the conveyor to convey, to a removal position, the sheet folded by the sheet folding device in response to the occurrence of the sheet jam, the removal position to be accessed by a user.

9. The folding apparatus according to claim 8, wherein the removal position is a sheet outlet of the folding apparatus.

10. An image forming system comprising:

an image forming apparatus configured to form an image on a sheet; and the folding apparatus according to claim 6, configured to fold the sheet on which the image is formed by the image forming apparatus.

* * * * *